US009212016B2

(12) United States Patent
Minakuchi et al.

(10) Patent No.: US 9,212,016 B2
(45) Date of Patent: Dec. 15, 2015

(54) IMAGE FORMING APPARATUS AUTOMATICALLY SETTING NOISE REDUCTION

(71) Applicant: Kyocera Document Solutions Inc., Osaka (JP)

(72) Inventors: Koji Minakuchi, Osaka (JP); Daiki Sone, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/474,135

(22) Filed: Aug. 30, 2014

(65) Prior Publication Data

US 2015/0061217 A1 Mar. 5, 2015

(30) Foreign Application Priority Data

Aug. 30, 2013 (JP) ..... 2013-180036
Aug. 30, 2013 (JP) ..... 2013-180038
Aug. 30, 2013 (JP) ..... 2013-180040
Aug. 18, 2014 (JP) ..... 2014-166042

(51) Int. Cl.
*B65H 3/44* (2006.01)
*G03G 15/00* (2006.01)
*G03G 21/20* (2006.01)

(52) U.S. Cl.
CPC ..... *B65H 3/44* (2013.01); *G03G 15/6502* (2013.01); *B65H 2551/10* (2013.01); *B65H 2551/20* (2013.01); *B65H 2601/521* (2013.01); *G03G 21/20* (2013.01); *G03G 2215/00949* (2013.01)

(58) Field of Classification Search
CPC ..... B65H 3/06; B65H 3/44; B65H 3/446; B65H 2551/10; B65H 2551/20; B65H 2601/521
USPC ..... 271/9.01, 9.05
See application file for complete search history.

(56) References Cited

U.S. PATENT DOCUMENTS 5,199,694 A * 4/1993 Iseda ..... 271/9.05

FOREIGN PATENT DOCUMENTS

JP 2007-320676 A 12/2007

* cited by examiner

*Primary Examiner* — David H Bollinger
(74) *Attorney, Agent, or Firm* — James W. Judge

(57) ABSTRACT

An image forming apparatus can exchange a sound reduction mode and a normal mode. The image forming apparatus includes a sound reduction sheet feed cassette, a normal sheet feed cassette, a sound reduction sheet feed cassette roller, and a normal sheet feed cassette roller. The sound reduction sheet feed cassette roller and the normal sheet feed cassette roller can exchange rotation speed to a slower speed than a normal paper feeding speed, In the sound reduction mode, the image forming apparatus performs one of a noise reduction high performance mode and a noise reduction low performance mode. In the normal mode, the image forming apparatus performs a high performance mode.

8 Claims, 11 Drawing Sheets

IMAGE FORMING APPARATUS AUTOMATICALLY SETTING NOISE REDUCTION

INCORPORATION BY REFERENCE

This application relates to and claims priority from Japanese Patent Application Nos. 2013-180036 and 2013-180040, each filed in the Japan Patent Office on Aug. 30, 2013, and Japanese Priority Patent Application No. 2014-166042 based on Japanese Patent Application No. 2013-180038, filed in the Japan Patent Office on Aug. 18, 2014, the entire disclosures of which are incorporated herein by reference.

BACKGROUND

Unless otherwise indicated herein, the description in this section is not prior art to the claims in this application and is not admitted to be prior art by inclusion in this section.

An image forming apparatus, such as a printer, a Multifunction Peripheral (MFP), or the like, develops an electrostatic latent image on a photoconductor with toner supplied from a developing equipment, transfers a toner image to a paper sheet extracted from a sheet feed cassette, and fixes the toner image on the paper sheet. Then, the paper sheet on which the toner image has been transferred is discharged from the image forming apparatus. In a process of printing on the paper sheet, when the paper sheet is extracted from the sheet feed cassette, cassette rollers rotate. A printing speed is faster, when the rotation of the cassette rollers is made faster. However, when the printing speed is faster, noise is larger by moving a plurality of units of the image forming apparatus, such as a scanner, motors, rollers, or the like. As a result, sound reduction property is lower. Meanwhile, the printing speed is slower, when the rotation of the cassette rollers is made slower. As a result, performance of the printing is lower. However, when the printing speed is lower, the noise is smaller and the sound reduction property is higher.

SUMMARY

According to an embodiment of the present disclosure, an image forming apparatus is configured to exchange a sound reduction mode and a normal mode. The image forming apparatus includes a sound reduction sheet feed cassette, a normal sheet feed cassette, a sound reduction sheet feed cassette roller that feeds a paper sheet from the sound reduction sheet feed cassette, and a normal sheet feed cassette roller that feeds the paper sheet from the normal sheet feed cassette.

The sound reduction sheet feed cassette roller and the normal sheet feed cassette roller are configured to exchange each of their rotation speed to a slower speed than a normal paper feeding speed, The image forming apparatus, when executing a print job, is configured to: in the case of the sound reduction mode, perform one of i) a noise reduction high performance mode that includes setting the rotation speed of the sound reduction sheet feed cassette roller to the normal feeding speed and feeding the paper sheet from the sound reduction sheet feed cassette, and ii) a noise reduction low performance mode that includes setting the rotation speed of the normal sheet feed cassette roller to the slower speed than the normal feeding speed and feeding the paper sheet from the normal sheet feed cassette. The image forming apparatus is configured to, in the case of the normal mode, perform a high performance mode that includes setting the rotation speed of the normal sheet feed cassette roller to the normal feeding speed and feeding the paper sheet from the normal sheet feed cassette.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
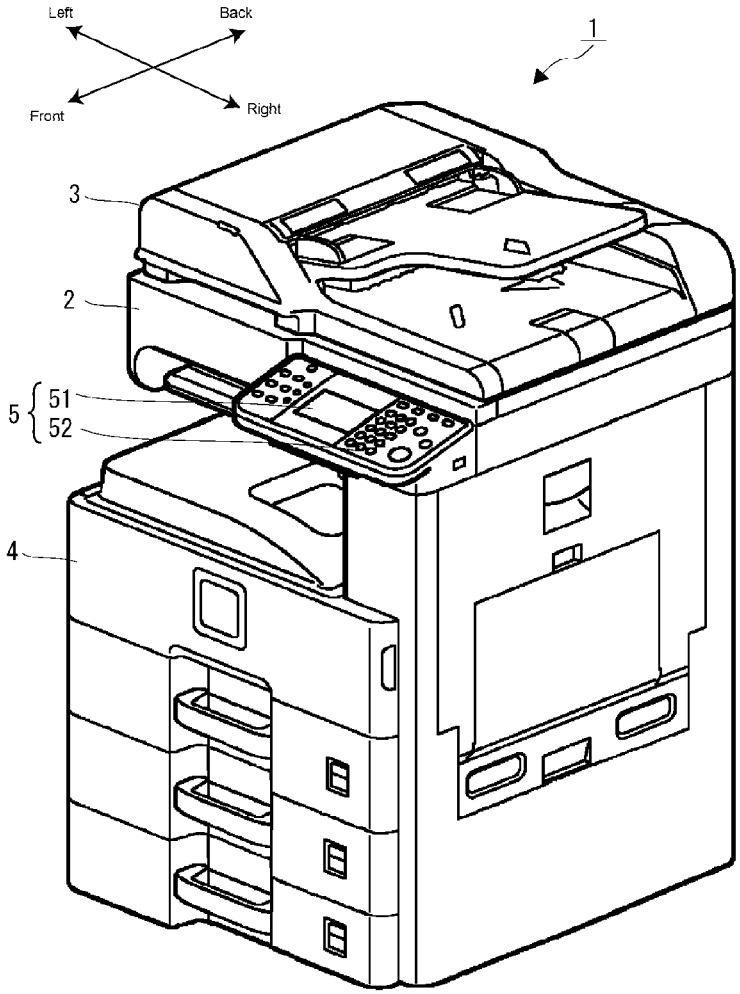
FIG. 1 is a schematic diagram illustrating an external configuration of an image forming apparatus according to a first embodiment of the present disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

First Embodiment

An embodiment will now be described with reference to the accompanying drawings. FIG. 1 is a schematic diagram illustrating an external configuration of an image forming apparatus 1 according to a first embodiment of the present disclosure. Note that, the external configuration of the image forming apparatus 1 according to the first embodiment is similar with the external configuration of the image forming apparatus of a second or a third embodiment described later. The image forming apparatus 1 includes a printer, a multifunctional peripheral, or the like. With reference to FIG. 1, the image forming apparatus 1 includes a document reading unit 2, a document feeding unit 3, a main unit 4, and an operation unit 5. The document reading unit 2 is arranged at an upper portion of the main unit 4. The document feeding unit 3 is arranged at an upper portion of the document reading unit 2.

The operation unit 5 is arranged at a front side of the image forming apparatus 1. The operation unit 5 configures settings of and instructs an operation on the image forming apparatus 1. The operation unit 5 includes a liquid crystal display unit 51 and an operation button 52. A user operates the operation unit 5 by inputting an instruction to configure various settings of the image forming apparatus 1, thus performing various functions such as image formation. The liquid crystal display unit 51 can perform various settings such as an indication of a state of the image forming apparatus 1, displays of a state of the image formation and the number of print copies; and as a touch panel, functions such as duplex printing and black-and-white inversion, magnification setting, and print density setting. The operation button 52 includes a start button, a stop/clear button, a reset button, a numeric keypad, or a similar button. The start button instructs a start of the image formation. The stop/clear button instructs aborting the image formation. The reset button is used to default various settings of the image forming apparatus 1. The third embodiment described later further includes an interrupt button that instructs an interrupt of the image formation as the operation button 52.

Figure 2:
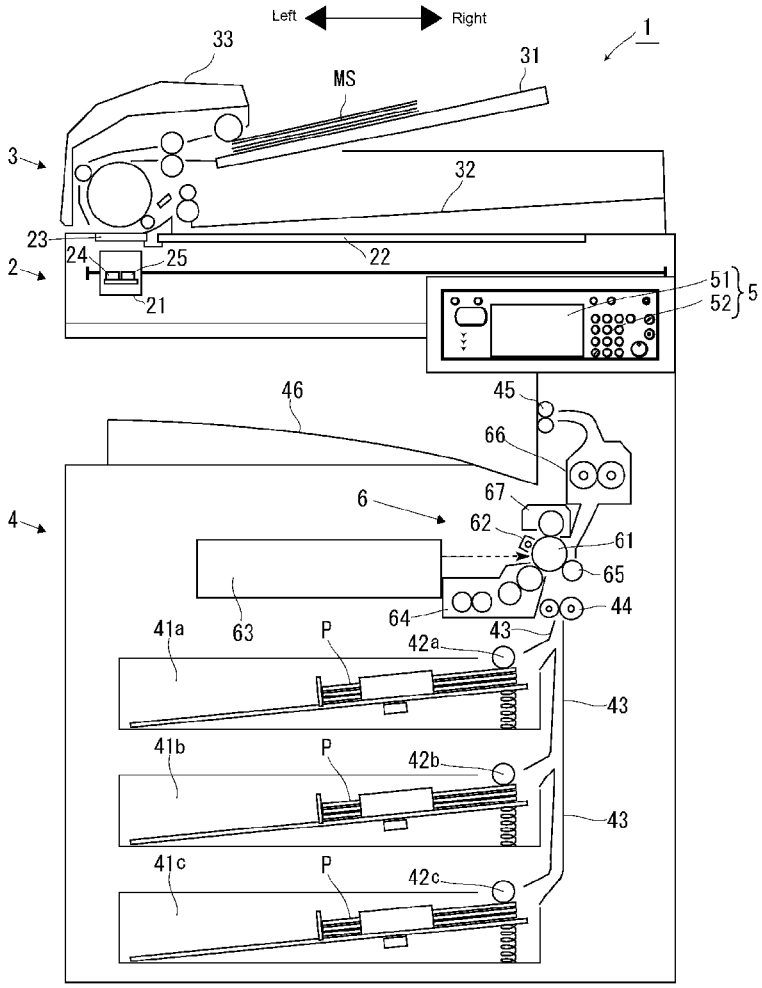
FIG. 2 is a schematic diagram illustrating an internal configuration of the image forming apparatus according to the first embodiment.

FIG. 2 is a schematic diagram illustrating an internal configuration of the image forming apparatus 1 according to the first embodiment. Note that, the internal configuration of the image forming apparatus 1 according to the first embodiment is similar with the internal configuration of the image forming apparatus of the second or the third embodiment described later. With reference to FIG. 2, the document reading unit 2 includes a scanner 21, a platen glass 22, and a document reading slit 23. The scanner 21 includes a light source 24 and a light receiving portion 25. The light source 24 uses a Light Emitting Diode (LED). The light receiving portion 25 is constituted of a Charge Coupled Device (CCD) line sensor, a Complementary Metal Oxide Semiconductor (CMOS) line sensor, or a similar component. The scanner 21 is configured to be movable in a conveyance direction of a document MS by the document feeding unit 3. The document reading slit 23 has a slit formed in a direction perpendicular to the conveyance direction of the document MS (e.g. manuscript) by the document feeding unit 3.

The document feeding unit 3 includes a document platen 31, a document discharging unit 32, and a document conveying mechanism 33. The document conveying mechanism 33 sequentially feeds the documents MS set on the document platen 31 one by one. The documents MS are conveyed to the position facing the document reading slit 23, and then are discharged to the document discharging unit 32. The document feeding unit 3 and the document reading unit 2 are connected with a hinge mechanism at a back side of the image forming apparatus 1. The document feeding unit 3 functions as a platen cover with which a top surface of the platen glass 22 opens or closes. Opening the document feeding unit 3 upward opens the top surface of the platen glass 22, thus, the documents MS can be set on the platen glass 22.

With the documents MS not set at the document platen 31 and the document feeding unit 3 (platen cover) open (open state), when reading of the document MS is instructed with the operation button 52 of the operation unit 5, the document MS set at the platen glass 22 is read. To read the document MS placed on the platen glass 22, the scanner 21 is moved to a position opposed to the platen glass 22, reads the document MS set on the platen glass 22 while scanning it from a sub-scanning direction base line B in a sub-scanning direction, which is perpendicular to a main-scanning direction, to obtain image data, and then outputs the obtained image data to a control unit 7 (FIG. 3), which is in the main unit 4.

With the document MS set at the document platen 31, when reading of the document MS is instructed with the operation button 52 of the operation unit 5, the document MS conveyed by the document feeding unit 3 is read. The document MS is set at the document platen 31 with its front surface (surface from which a document image is to be read) upward. Then, the document feeding unit 3 conveys the document MS set at the document platen 31 from a left side. Thus, the front surface of the document MS is led to a position opposed to the document reading slit 23. To read the document MS conveyed by the document feeding unit 3, the scanner 21 is moved to a position opposed to the document reading slit 23, reads the document MS in synchronization with a conveying operation by the document feeding unit 3 via the document reading slit 23 to obtain the image data, and then outputs the obtained image data to the control unit 7 (FIG. 3), which is in the main unit 4.

The main unit 4 includes a normal sheet feed cassette 41*a*, a normal sheet feed cassette 41*b*, a sound reduction sheet feed cassette 41*c*, a normal sheet feed cassette roller 42*a*, a normal sheet feed cassette roller 42*b*, a sound reduction sheet feed cassette roller 42*c*, a paper sheet conveyance passage 43, a conveyance roller 44, and a discharge roller 45, as well as a recording unit 6. The normal sheet feed cassette 41*a* and the normal sheet feed cassette 41*b* are sheet feed cassettes that include a plurality of the paper sheets P to which no sound reduction measures have been taken. The normal sheet feed cassette roller 42*a* feeds the paper sheets P from the normal sheet feed cassette 41*a* to the paper sheet conveyance passage 43 one by one. The normal sheet feed cassette roller 42*b* feeds the paper sheet P from the normal sheet feed cassette 41*b* to the paper sheet conveyance passage 43 one by one. The sound reduction sheet feed cassette 41*c* is a sheet feed cassette that includes a plurality of the paper sheets P on which the sound reduction measures have been taken. For example, all surfaces or a part of surfaces of the sound reduction sheet feed cassette 41*c* is covered with a sound absorbing member. The sound reduction sheet feed cassette roller 42*c* feeds the paper sheets P from the sound reduction sheet feed cassette 41*c* to the paper sheet conveyance passage 43 one by one. The paper sheet P fed to the paper sheet conveyance passage 43 by the normal sheet feed cassette roller 42*a*, the normal sheet feed cassette roller 42*b*, or the sound reduction sheet feed cassette roller 42*c* is conveyed to the recording unit 6 by the conveyance roller 44. The conveyance roller 44 conveys the paper sheet P such that a distal end of the paper sheet P supplied from the normal sheet feed cassette roller 42*a*, the normal sheet feed cassette roller 42*b*, or the sound reduction sheet feed cassette roller 42*c* matches a distal end of an image read from the document MS. Then, the discharge roller 45 discharges the paper sheet P recorded by the recording unit 6 to a discharge space 46 formed between the document reading unit 2 and the main unit 4. Thus, the normal sheet feed cassette roller 42*a*, the normal sheet feed cassette roller 42*b*, the sound reduction sheet feed cassette roller 42*c*, the conveyance roller 44, and the discharge roller 45 function as a conveying unit of the paper sheet P. The normal sheet feed cassette roller 42*a*, the normal sheet feed cassette roller 42*b*, and the sound reduction sheet feed cassette roller 42*c* have a "noise reduction setting" that reduces a paper feeding speed to the half of the normal paper feeding speed (hereinafter referred to as "a half speed"). When "the noise reduction setting" is released, speeds of the normal sheet feed cassette roller 42*a*, the normal sheet feed cassette roller 42*b*, and the sound reduction sheet feed cassette roller 42*c* return to a full (hereinafter referred to as the normal paper feeding speed="full speed").

The recording unit 6 includes a photoreceptor drum 61, a charging unit 62, an exposing unit 63, an image forming unit 64, a transfer unit 65 a fixing unit 66, and a cleaning unit 67. The exposing unit 63 is an optical unit that includes a laser device, a mirror, or a similar unit. The exposing unit 63 forms an electrostatic latent image on the surface of the photoreceptor drum 61 by outputting laser beam for exposure based on the image data on the photoreceptor drum 61 uniformly charged by the charging unit 62. The image forming unit 64 is a developer unit that develops the electrostatic latent image formed on the photoreceptor drum 61 using toner and forms the toner image based on the electrostatic latent image on the photoreceptor drum 61. The transfer unit 65 causes the toner image, which is formed on the photoreceptor drum 61 by the image forming unit 64, to be transferred on the paper sheet P. The fixing unit 66 heats the paper sheet P on which the toner image has been transferred by the transfer unit 65 to fix the toner image on the paper sheet P. The cleaning unit 67 removes toner remaining on the photoreceptor drum 61.

Figure 3:
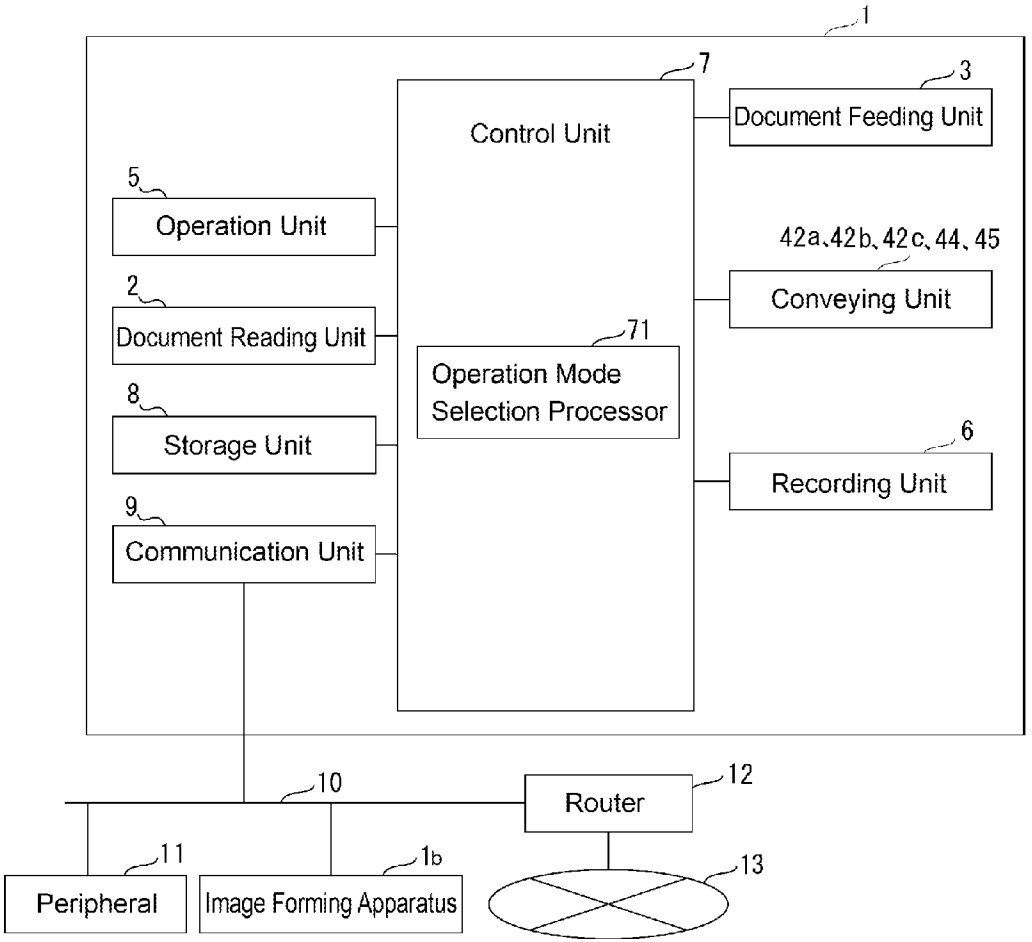
FIG. 3 is a schematic diagram illustrating a functional block configuration of the image forming apparatus according to the first embodiment.

FIG. 3 is a schematic diagram illustrating a functional block configuration of the image forming apparatus 1 according to the first embodiment. Note that, the functional block configuration of the image forming apparatus 1 according to the first embodiment is similar with the functional block configuration of the image forming apparatus of the second embodiment described later. The above-described document reading unit 2, document feeding unit 3, conveying unit (the normal sheet feed cassette roller 42*a*, the normal sheet feed cassette roller 42*b*, the sound reduction sheet feed cassette roller 42*c*, conveyance roller 44, and discharge roller 45), operation unit 5, recording unit 6, storage unit 8, and communication unit 9 are connected to the control unit 7. Accordingly, the control unit 7 controls the respective operations of these units. The control unit 7 includes an operation mode selection processor 71.

The control unit 7 is an information processing unit such as a microcomputer that includes a read only memory (ROM), a random access memory (RAM), and a similar memory. The ROM stores a control program for performing the operation control of the image forming apparatus 1. The control unit 7 reads out the control program stored in the ROM and loads the control program on the RAM, so as to perform a control on the entire apparatus corresponding to specified instruction information input from the operation unit 5. Additionally, the control unit 7 can automatically detect a paper sheet size included in the normal sheet feed cassette 41*a*, the normal sheet feed cassette 41*b*, and the sound reduction sheet feed cassette 41*c*. When any of a mode for performing a print job with reduced noise (hereinafter referred to as "sound reduction mode") or a mode for performing the print job prioritizing performance over noise reduction (hereinafter referred to as "normal mode") is selected on the operation unit 5, the operation mode selection processor 71 controls the print job in the selected operation mode. The details of the process by the operation mode selection processor 71 will be described later.

The storage unit 8 is a storage unit such as a semiconductor memory and a Hard Disk Drive (HDD). The storage unit 8 stores image data of the document MS read by the scanner 21 and also stores various management information and setting information. The storage unit 8 stores the accumulated number of output sheets of the sound reduction sheet feed cassette 41*c*. When the sound reduction sheet feed cassette 41*c* is exchanged, the control unit 7 resets the accumulated number of output sheets of the sound reduction sheet feed cassette 41*c*.

The communication unit 9 has a function to transmit and receive various data from/to a peripheral 11 such as a personal computer and another image forming apparatus 1*b* via a network 10 such as LAN. The communication unit 9 is connectable to an Internet 13 via the network 10 and a router 12. The communication unit 9 has a function to transmit and receive various data from/to various communication devices connected to the Internet 13.

The following describes a setting procedure of the operation mode of the image forming apparatus 1. The user does not set the operation mode on each print job but the administrator sets the operation mode according to an environment where the image forming apparatus 1 is installed, a time slot, or a similar condition. First, when the administrator selects "the operation mode" among setting items displayed on the touch panel of the liquid crystal display unit 51, "the sound reduction mode" or "the normal mode" is displayed. Then, the administrator selects any of "the sound reduction mode" or "the normal mode". When the operation unit 5 inputs "the sound reduction mode" or "the normal mode" selected by the user (including the administrator) and outputs the mode to the control unit 7, the control unit 7 stores "the sound reduction mode" or "the normal mode" in the storage unit 8.

Figure 4A:
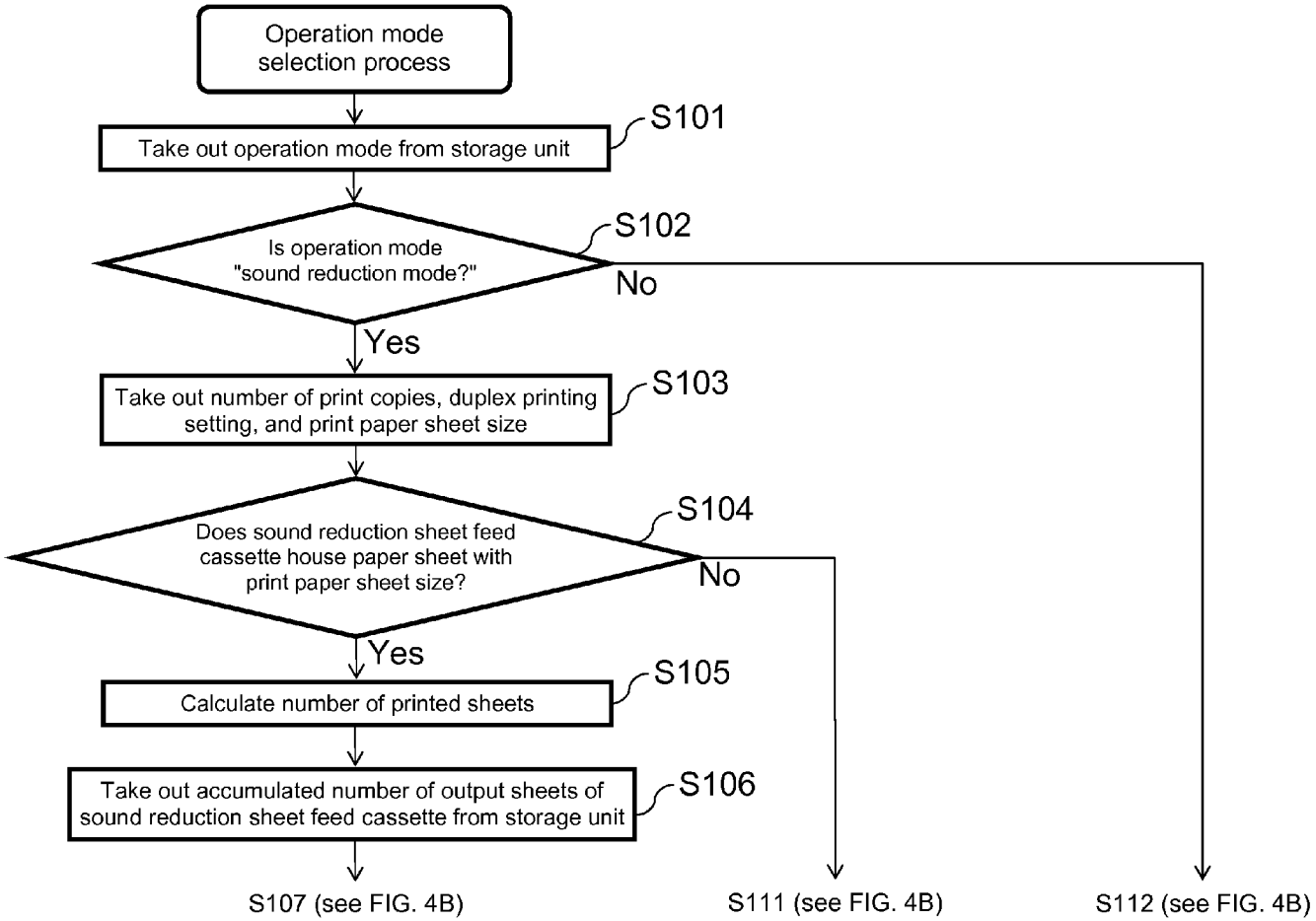
FIGS. 4A and 4B are flowcharts of an operation mode selection process according to the first embodiment.
Figure 4B:
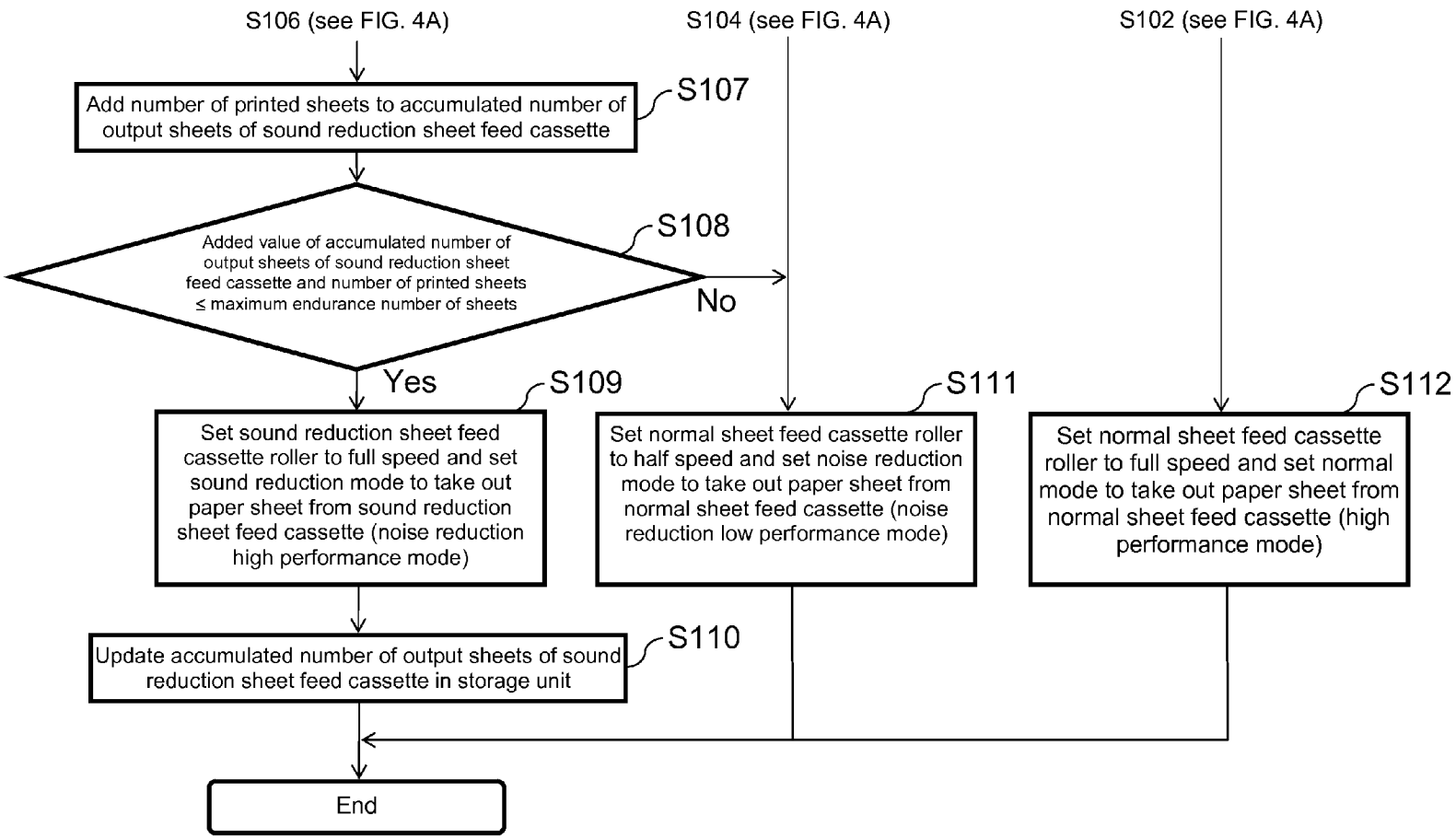

The following describes the operation mode selection process by the image forming apparatus 1 according to the first embodiment with reference to FIGS. 4A and 4B. When the user sets the number of print copies, duplex printing setting, print paper sheet size, magnification, print density, or a similar element from the touch panel of the liquid crystal display unit 51 and starts printing with the operation button 52, the operation unit 5 inputs these settings and print start so as to output the inputs to the control unit 7. When these settings and print start are input to the control unit 7, the control unit 7 activates the operation mode selection processor 71, and the operation mode selection processor 71 starts the operation mode selection process.

At Step S101, the operation mode selection processor 71 takes out the operation mode stored in the storage unit 8.

At Step S102, the operation mode selection processor 71 determines whether the operation mode taken out at Step S101 is "the sound reduction mode" or not. When the operation mode is "the sound reduction mode" (Yes at Step S102), the process proceeds to Step S103. When the operation mode is not "the sound reduction mode" (No at Step S102), the process proceeds to Step S112.

At Step S103, in the case of Yes at Step S102, the operation mode selection processor 71 takes out the number of print copies, the duplex printing setting, and the print paper sheet size from the control unit 7.

At Step S104, the operation mode selection processor 71 determines whether the sound reduction sheet feed cassette 41*c* includes the paper sheet P with the print paper sheet size or not. When the sound reduction sheet feed cassette 41*c* includes the paper sheet P with the print paper sheet size (Yes at Step S104), the process proceeds to Step S105. When the sound reduction sheet feed cassette 41*c* does not include the paper sheet P with the print paper sheet size (No at Step S104), the process proceeds to Step S111.

At Step S105, the operation mode selection processor 71 calculates the number of printed sheets from the number of sheets of the document MS, the number of print copies, and the duplex printing setting. For example, assume that the number of sheets of the document MS is (p), the number of print copies is (b), and the duplex printing setting is configured, the number of printed sheets=(P×b)/2 is calculated.

At Step S106, the operation mode selection processor 71 takes out the accumulated number of output sheets of the sound reduction sheet feed cassette 41*c* stored in the storage unit 8.

At Step S107, the operation mode selection processor 71 adds the number of printed sheets calculated at Step S105 to the accumulated number of output sheets of the sound reduction sheet feed cassette 41*c* taken out at Step S106.

At Step S108, the operation mode selection processor 71 determines whether the added value of the accumulated number of output sheets of the sound reduction sheet feed cassette 41*c* and the number of printed sheets added at Step S107 is equal to or less than the maximum number of outputtable sheets (hereinafter referred to as "maximum endurance number of sheets") or not. The maximum endurance number of sheets is a value within which the specified durability of the sound reduction sheet feed cassette 41*c* can be maintained. Thus, the operation mode selection processor 71 determines whether the sound reduction sheet feed cassette 41*c* endures or not. When the value is equal to or less than the maximum endurance number of sheets of the sound reduction sheet feed cassette 41*c* (with durability) (Yes at Step S108), the process proceeds to Step S109. When the value is not equal to or less than the maximum endurance number of sheets of the sound reduction sheet feed cassette 41*c* (without durability) (No at Step S108), the process proceeds to Step S111.

At Step S109, in the case of Yes at Step S108, the operation mode selection processor 71 sets the sound reduction sheet feed cassette roller 42*c* to "the full speed", sets the sound reduction mode to take out the paper sheet P from the sound reduction sheet feed cassette 41*c* (hereinafter referred to as "noise reduction high performance mode"), and terminates the operation mode selection process. For example, when the print paper sheet size is "A4 size", and the paper sheet P included in the sound reduction sheet feed cassette 41*c* is "A4 size", the paper sheet P is taken out from the sound reduction sheet feed cassette 41*c* with the sound reduction sheet feed cassette roller 42*c* at "the full speed."

At Step S110, the operation mode selection processor 71 updates the accumulated number of output sheets of the sound reduction sheet feed cassette 41*c* stored in the storage unit 8, to the added value of the accumulated number of output sheets of the sound reduction sheet feed cassette 41*c* and the number of printed sheets, which are added at Step S104, and terminates the operation mode selection process.

At Step S111, in the case of No in Step S104 or No in Step S108, the normal sheet feed cassette roller 42*a* of the normal sheet feed cassette 41*a* or the normal sheet feed cassette roller 42*b* of the normal sheet feed cassette 41*b* including the paper sheet P with the print paper sheet size is decelerated to "half speed", the noise reduction mode to take out the paper sheet P from the normal sheet feed cassette 41*a* or the normal sheet feed cassette 41*b* (hereinafter referred to as "noise reduction low performance mode") is set, and the operation mode selection process is terminated. For example, when the print paper sheet size is "A3 size" and the paper sheet P included in the normal sheet feed cassette 41*b* is "A3 size", the paper sheet P is taken out from the normal sheet feed cassette 41*b* with the normal sheet feed cassette roller 42*b* at "the half speed."

At Step S112, in the case of No in Step S102, the normal sheet feed cassette roller 42*a* of the normal sheet feed cassette 41*a* or the normal sheet feed cassette roller 42*b* of the normal sheet feed cassette 41*b* including the paper sheet P with the print paper sheet size is set to "the full speed", the normal mode to take out the paper sheet P from the normal sheet feed cassette 41*a* or the normal sheet feed cassette 41*b* (hereinafter referred to as "high performance mode") is set, and the operation mode selection process is terminated. For example, when the print paper sheet size is "A4 size" and the paper sheet P included in the normal sheet feed cassette 41*a* is "A4 size", the paper sheet P is taken out from the normal sheet feed cassette 41*a* with the normal sheet feed cassette roller 42*a* at "the full speed."

Accordingly, in "the sound reduction mode" of the operation mode, when the sound reduction sheet feed cassette 41*c* includes the paper sheet P with the print paper sheet size and the sound reduction sheet feed cassette 41*c* is equal to or less than the maximum endurance number of sheets, setting the sound reduction sheet feed cassette roller 42*c* of the sound reduction sheet feed cassette 41*c* to the full speed ensures the maximum noise reduction. When the sound reduction sheet feed cassette 41*c* does not include the paper sheet P with the print paper sheet size or the sound reduction sheet feed cassette 41*c* is not equal to or less than the maximum endurance number of sheets, setting the normal sheet feed cassette roller 42*a* or the normal sheet feed cassette roller 42*b* corresponding to the normal sheet feed cassette 41*a* or the normal sheet feed cassette 41*b* including the paper sheet P with the print paper sheet size to the half speed ensures noise reduction even for the normal sheet feed cassette. This prevents the sound reduction sheet feed cassette 41*c*, which requires high costs, from wearing, thus ensuring coexistence of noise reduction and performance. In "the normal mode" of the operation mode, setting the normal sheet feed cassette roller 42*a* or the normal sheet feed cassette roller 42*b* corresponding to the normal sheet feed cassette 41*a* or the normal sheet feed cassette 41*b* including the paper sheet P with the print paper sheet size to the full speed ensures improving performance. Since the sound reduction sheet feed cassette 41*c* is not used, this can prevent the sound reduction sheet feed cassette 41*c*, which requires a high cost, from wearing.

The embodiment where the image forming apparatus 1 includes the normal sheet feed cassette 41*a*, the normal sheet feed cassette 41*b*, and the sound reduction sheet feed cassette 41*c* is described above. This, however, should not be construed in a limiting sense. The image forming apparatus 1 can also include a plurality of sound reduction sheet feed cassettes.

Regarding the speeds of the normal sheet feed cassette roller 42*a*, the normal sheet feed cassette roller 42*b*, and the sound reduction sheet feed cassette roller 42*c*, two levels of the full speed and the half speed are employed. However, this is merely an example. The speeds can include a plurality of levels with respect to the normal paper feeding speed, such as the full speed, ⅔, and ⅓; or the full speed, ¾, ⅔, and ¼.

The user can change the maximum endurance number of sheets of the sound reduction sheet feed cassette 41*c* of the operation mode selection process by inputting the value from the operation unit 5 and storing the value in the storage unit 8.

The operation mode selection process adds the accumulated number of output sheets of the sound reduction sheet feed cassette 41*c* to the number of printed sheets and updates the accumulated number of output sheets of the sound reduction sheet feed cassette 41*c*. This, however, should not be construed in a limiting sense. The sound reduction sheet feed cassette roller 42*c* can be provided with a counter. This counter can count the number of paper sheets P fed from the sound reduction sheet feed cassette roller 42*c* to paper sheet conveyance passage 43. Then, the count value can be the accumulated number of output sheets of the sound reduction sheet feed cassette 41*c*. When exchanging the sound reduction sheet feed cassette 41*c*, the counter resets the count value.

The operation mode selection process determines whether to automatically select the sound reduction sheet feed cassette

41*c* or not. However, manually selecting the sound reduction sheet feed cassette 41*c* from the operation unit 5 is also possible. In this case, even if the value is not equal to or less than the maximum endurance number of sheets of the sound reduction sheet feed cassette 41*c*, the print output can be performed from the sound reduction sheet feed cassette 41*c*.

The procedure of performing the print job from the touch panel of the liquid crystal display unit 51 of the image forming apparatus 1 is described. However, even if the print output is performed from the peripheral 11 connected to the network 10 to the image forming apparatus 1 or the other image forming apparatus 1*b*, the operation mode selection process can be performed.

Such image forming apparatus of the first embodiment uses both the sound reduction sheet feed cassette and the normal sheet feed cassette. Additionally, considering durability of the sound reduction sheet feed cassette, selection between the sound reduction sheet feed cassette and the normal sheet feed cassette reduces the cost. Further, automatic noise reduction setting ensures improving user's convenience and performance.

Second Embodiment

Figure 5A:
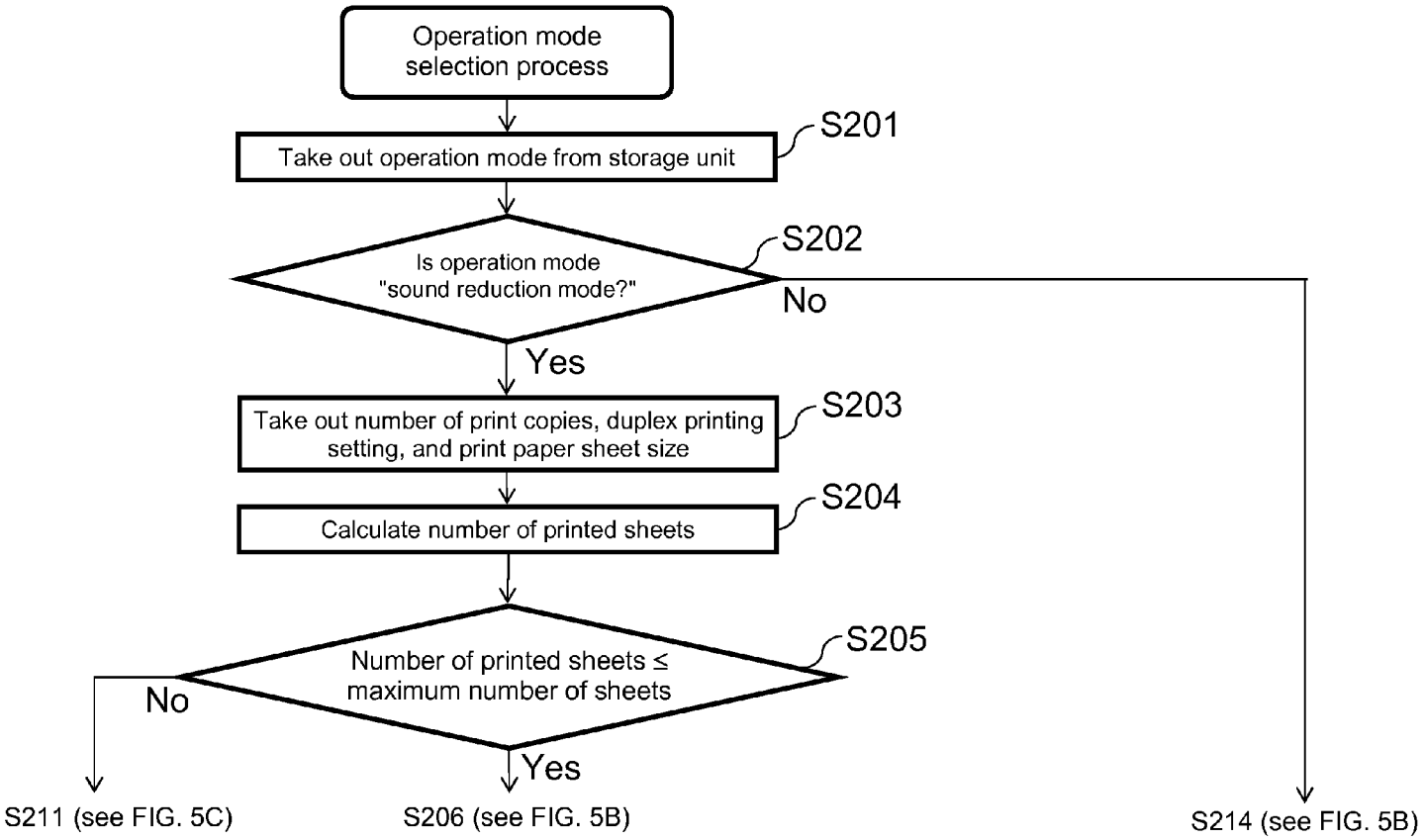
FIGS. 5A, 5B and 5C are flowcharts of an operation mode selection process according to a second embodiment of the present disclosure.
Figure 5B:
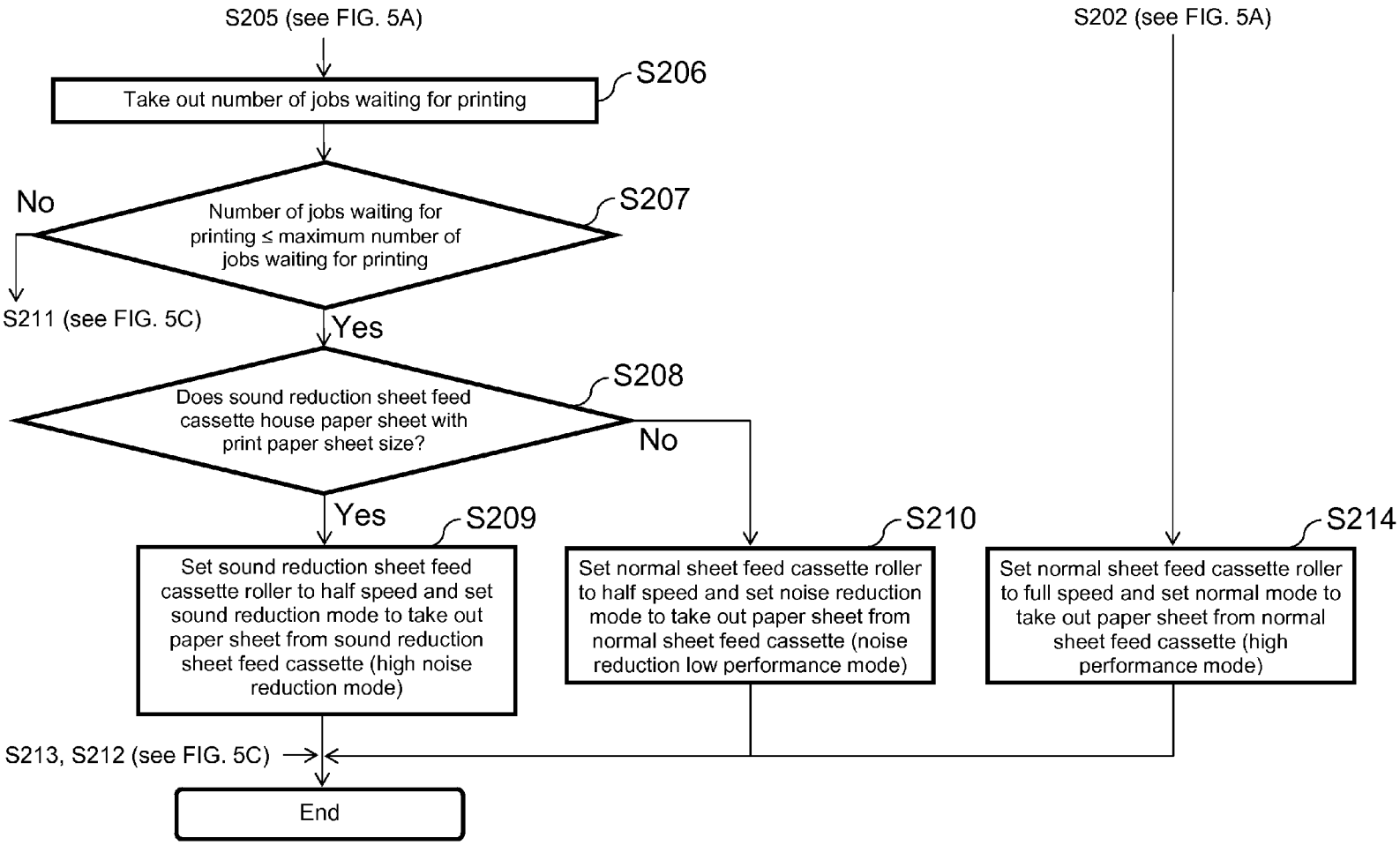
Figure 5C:
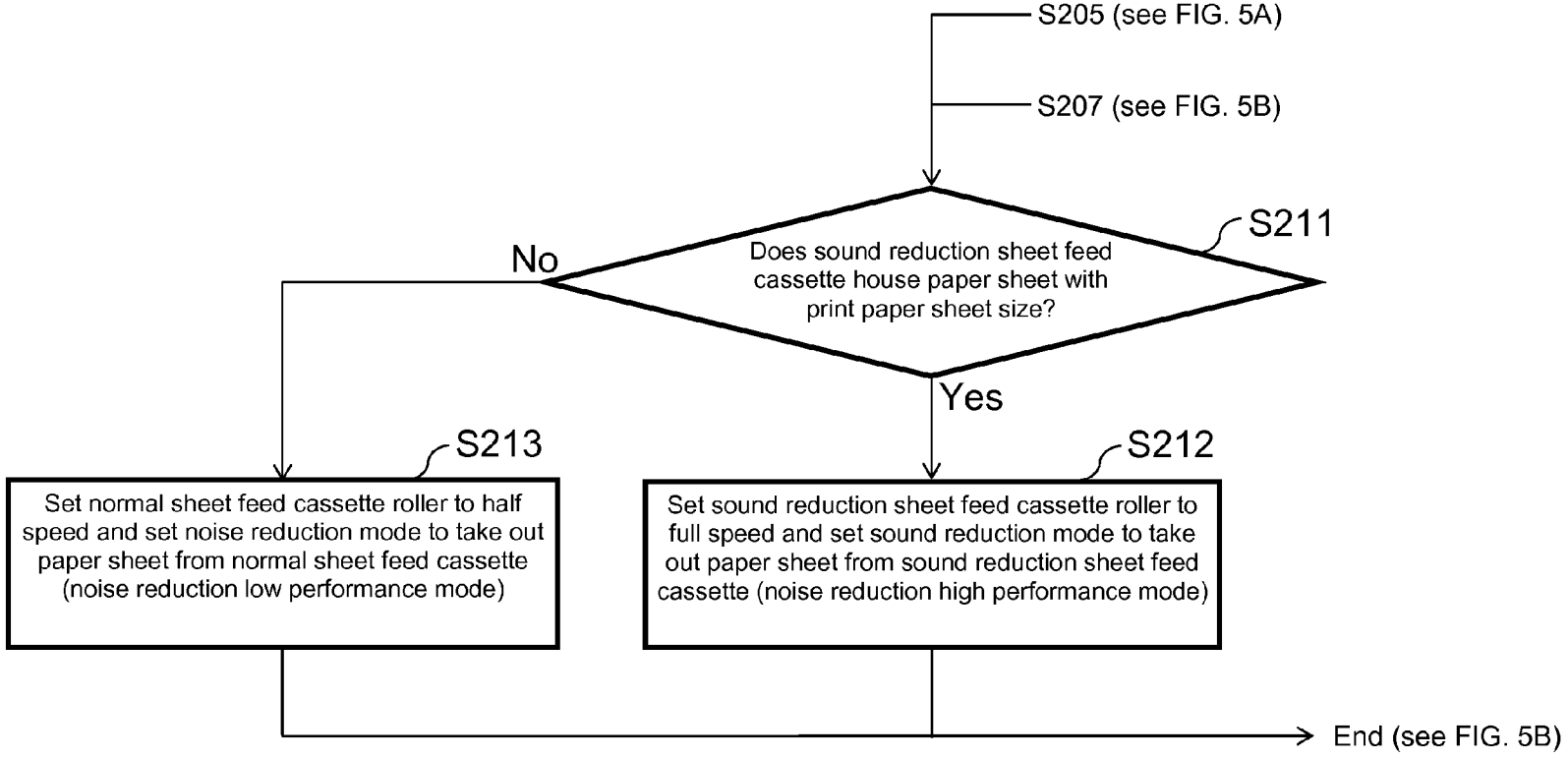

The following describes the operation mode selection process by the image forming apparatus 1 according to the second embodiment with reference to FIGS. 5A, 5B and 5C.

At Step S201, the operation mode selection processor 71 takes out the operation mode stored in the storage unit 8.

At Step S202, the operation mode selection processor 71 determines whether the operation mode taken out at Step S201 is "the sound reduction mode" or not. When the operation mode is "the sound reduction mode" (Yes at Step S202), the process proceeds to Step S203. When the operation mode is not "the sound reduction mode" (No at Step S202), the process proceeds to Step S214.

At Step S203, in the case of Yes in Step S202, the operation mode selection processor 71 takes out the number of print copies, the duplex printing setting, and the print paper sheet size from the control unit 7.

At Step S204, the operation mode selection processor 71 calculates the number of printed sheets from the number of sheets of the document MS, the number of print copies, and the duplex printing setting. For example, assume that the number of sheets of the document MS is (p), the number of print copies is (b), and the duplex printing setting is configured, the number of printed sheets=(P×b)/2 is calculated.

At Step S205, the operation mode selection processor 71 determines whether the number of printed sheets calculated at Step S204 is equal to or less than the specified maximum number of sheets or not. When the number of printed sheets is equal to or less than the maximum number of sheets (Yes at S205), the process proceeds to Step S206. When the number of printed sheets is not equal to or less than the maximum number of sheets (No at Step S205), the process proceeds to Step S211.

At Step S206, in the case of Yes in Step S205, the operation mode selection processor 71 takes out the number of print jobs that waits for printing from the control unit 7 (hereinafter referred to as "the number of jobs waiting for printing"). The control unit 7 controls the print job; therefore, the control unit 7 is in charge of counting the number of jobs waiting for printing.

At Step S207, the operation mode selection processor 71 determines whether the number of jobs waiting for printing, which is taken out at Step S206, is equal to or less than the specified maximum number of jobs waiting for printing or not. When the number of jobs waiting for printing is equal to or less than the maximum number of jobs waiting for printing (Yes at Step S207), the process proceeds to Step S208. When the number of jobs waiting for printing is not equal to or less than the maximum number of jobs waiting for printing (No at Step S207), the process proceeds to Step S211.

At Step S208, in the case of Yes in Step S207, the operation mode selection processor 71 determines whether the sound reduction sheet feed cassette 41*c* includes the paper sheet P with the print paper sheet size or not. When the sound reduction sheet feed cassette 41*c* includes the paper sheet P with the print paper sheet size (Yes at Step S208), the process proceeds to Step S209. When the sound reduction sheet feed cassette 41*c* does not include the paper sheet P with the print paper sheet size (No at Step S208), the process proceeds to Step S210.

At Step S209, in the case of Yes in Step S208, the operation mode selection processor 71 sets the sound reduction sheet feed cassette roller 42*c* to "half speed", sets the sound reduction mode to take out the paper sheet P from the sound reduction sheet feed cassette 41*c* (hereinafter referred to as "high noise reduction mode"), and terminates the operation mode selection process. For example, when the print paper sheet size is "A4 size", and the paper sheet P included in the sound reduction sheet feed cassette 41*c* is "A4 size", the paper sheet P is taken out from the sound reduction sheet feed cassette 41*c* with the sound reduction sheet feed cassette roller 42*c* at "the half speed."

At Step S210, in the case of No in Step S208, the normal sheet feed cassette roller 42*a* of the normal sheet feed cassette 41*a* or the normal sheet feed cassette roller 42*b* of the normal sheet feed cassette 41*b* including the paper sheet P with the print paper sheet size is decelerated to "half speed", the noise reduction mode to take out the paper sheet P from the normal sheet feed cassette 41*a* or the normal sheet feed cassette 41*b* (hereinafter referred to as "noise reduction low performance mode") is set, and the operation mode selection process is terminated. For example, when the print paper sheet size is "A3 size" and the paper sheet P included in the normal sheet feed cassette 41*b* is "A3 size", the paper sheet P is taken out from the normal sheet feed cassette 41*b* with the normal sheet feed cassette roller 42*b* at "the half speed."

At Step S211, in the case of No in S205 or No in Step S207, the operation mode selection processor 71 determines whether the sound reduction sheet feed cassette 41*c* includes the paper sheet P with the print paper sheet size or not. When the sound reduction sheet feed cassette 41*c* includes the paper sheet P with the print paper sheet size (Yes at Step S211), the process proceeds to Step S212. When the sound reduction sheet feed cassette 41*c* does not include the paper sheet P with the print paper sheet size (No at Step S211), the process proceeds to Step S213.

At Step S212, in the case of Yes in Step S211, the operation mode selection processor 71 sets the sound reduction sheet feed cassette roller 42*c* to "the full speed", sets the sound reduction mode to take out the paper sheet P from the sound reduction sheet feed cassette 41*c* (hereinafter referred to as "noise reduction high performance mode"), and terminates the operation mode selection process. For example, when the print paper sheet size is "A4 size", and the paper sheet P included in the sound reduction sheet feed cassette 41*c* is "A4 size", the paper sheet P is taken out from the sound reduction sheet feed cassette 41*c* with the sound reduction sheet feed cassette roller 42*c* at "the full speed."

At Step S213, in the case of No in Step S211, the normal sheet feed cassette roller 42*a* of the normal sheet feed cassette 41*a* or the normal sheet feed cassette roller 42*b* of the normal sheet feed cassette 41*b* including the paper sheet P with the print paper sheet size is decelerated to "half speed", the noise reduction mode to take out the paper sheet P from the normal sheet feed cassette 41*a* or the normal sheet feed cassette 41*b* (hereinafter referred to as "noise reduction low performance mode") is set, and the operation mode selection process is terminated. For example, when the print paper sheet size is "A3 size" and the paper sheet P included in the normal sheet feed cassette 41*b* is "A3 size", the paper sheet P is taken out from the normal sheet feed cassette 41*b* with the normal sheet feed cassette roller 42*b* at "the half speed."

At Step S214, in the case of No in Step S202, the normal sheet feed cassette roller 42*a* of the normal sheet feed cassette 41*a* or the normal sheet feed cassette roller 42*b* of the normal sheet feed cassette 41*b* including the paper sheet P with the print paper sheet size is accelerated to "the full speed", the normal mode to take out the paper sheet P from the normal sheet feed cassette 41*a* or the normal sheet feed cassette 41*b* (hereinafter referred to as "the high performance mode") is set, and the operation mode selection process is terminated. For example, when the print paper sheet size is "A4 size" and the paper sheet P included in the normal sheet feed cassette 41*a* is "A4 size", the paper sheet P is taken out from the normal sheet feed cassette 41*a* with the normal sheet feed cassette roller 42*a* at "the full speed."

Accordingly, in "the sound reduction mode" of the operation mode, when the number of printed sheets is equal to or less than the maximum number of sheets or the number of jobs waiting for printing is equal to or less than the maximum number of jobs waiting for printing, and the sound reduction sheet feed cassette 41*c* includes the paper sheet P with the print paper sheet size, setting the sound reduction sheet feed cassette roller 42*c* of the sound reduction sheet feed cassette 41*c* to the half speed ensures the maximum noise reduction. When the sound reduction sheet feed cassette 41*c* does not include the paper sheet P with the print paper sheet size, setting the normal sheet feed cassette roller 42*a* or the normal sheet feed cassette roller 42*b* corresponding to the normal sheet feed cassette 41*a* or the normal sheet feed cassette 41*b* including the paper sheet P with the print paper sheet size to the half speed ensures noise reduction even for the normal sheet feed cassette. In "the sound reduction mode" of the operation mode, when the number of printed sheets is not equal to or less than the maximum number of sheets or the number of jobs waiting for printing is not equal to or less than the maximum number of jobs waiting for printing, and the sound reduction sheet feed cassette 41*c* includes the paper sheet P with the print paper sheet size, setting the sound reduction sheet feed cassette roller 42*c* of the sound reduction sheet feed cassette 41*c* to the full speed ensures coexistence of the noise reduction and the performance. When the sound reduction sheet feed cassette 41*c* does not include the paper sheet P with the print paper sheet size, setting the normal sheet feed cassette roller 42*a* or the normal sheet feed cassette roller 42*b* corresponding to the normal sheet feed cassette 41*a* or the normal sheet feed cassette 41*b* including the paper sheet P with the print paper sheet size to the half speed ensures the noise reduction even for the normal sheet feed cassette. In "the normal mode" of the operation mode, setting the normal sheet feed cassette roller 42*a* or the normal sheet feed cassette roller 42*b* corresponding to the normal sheet feed cassette 41*a* or the normal sheet feed cassette 41*b* including the paper sheet P with the print paper sheet size to the full speed ensures improving the performance. Since the sound reduction sheet feed cassette 41*c* is not used, this can prevent the sound reduction sheet feed cassette 41*c*, which requires a high cost, from wearing.

The embodiment where the image forming apparatus 1 includes the normal sheet feed cassette 41*a*, the normal sheet feed cassette 41*b*, and the sound reduction sheet feed cassette 41*c* is described above. This, however, should not be construed in a limiting sense. The image forming apparatus 1 can also include a plurality of sound reduction sheet feed cassettes.

Regarding the speeds of the normal sheet feed cassette roller 42*a*, the normal sheet feed cassette roller 42*b*, and the sound reduction sheet feed cassette roller 42*c*, two levels of the full speed and the half speed are employed. However, this is merely an example. The speeds can include a plurality of levels with respect to the normal paper feeding speed, such as the full speed, ⅔, and ⅓; or the full speed, ¾, ⅔, and ¼.

The user can change the maximum number of sheets and the maximum number of jobs waiting for printing used in the operation mode selection process by inputting the values from the operation unit 5 and storing the values in the storage unit 8.

The procedure of performing the print job from the touch panel of the liquid crystal display unit 51 of the image forming apparatus 1 is described. However, even if the print output is performed from the peripheral 11 connected to the network 10 to the image forming apparatus 1 or the other image forming apparatus 1*b*, the operation mode selection process can be performed.

Such image forming apparatus of the second embodiment uses both the sound reduction sheet feed cassette and the normal sheet feed cassette, reducing the cost. Automatically performing the selection of the normal sheet feed cassette and the sound reduction sheet feed cassette; and the noise reduction setting on each print job ensures improving user's convenience and performance.

Third Embodiment

Figure 6:
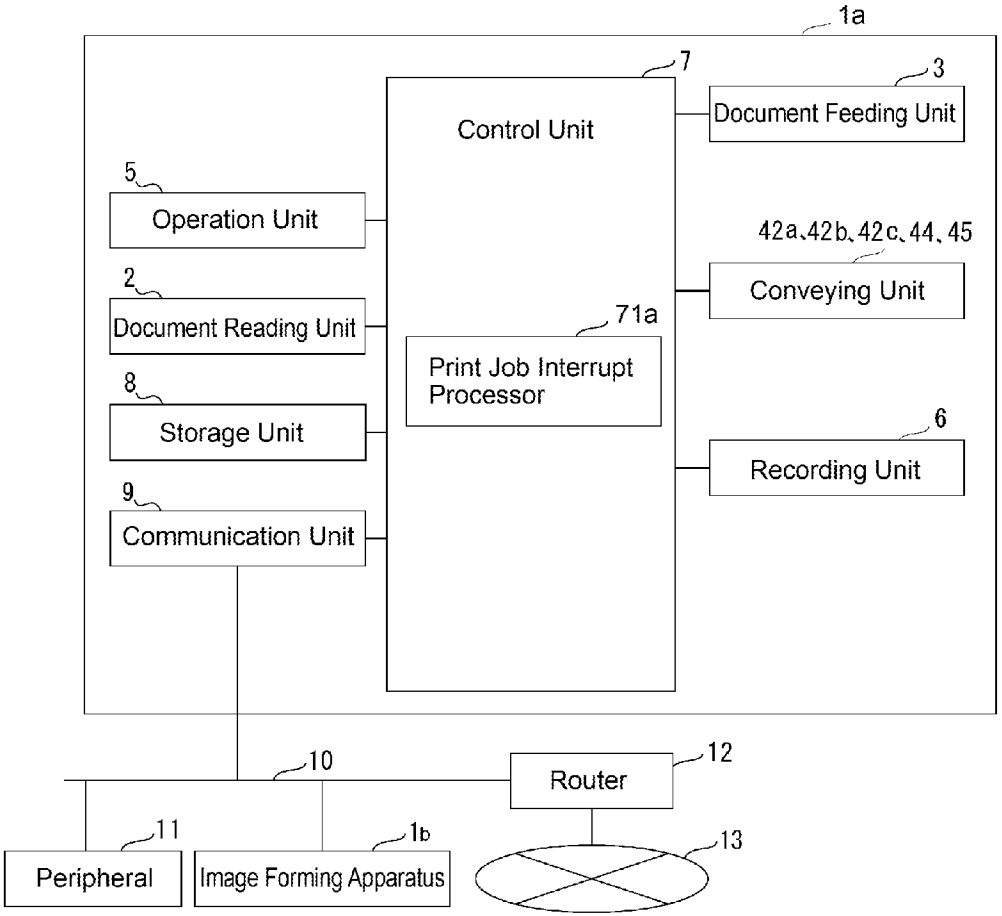
FIG. 6 is a schematic diagram illustrating a functional block configuration of the image forming apparatus according to a third embodiment of the present disclosure.

FIG. 6 is a schematic diagram illustrating a functional block configuration of the image forming apparatus 1*a* according to the third embodiment. The image forming apparatus 1*a* according to the third embodiment differs from the image forming apparatus 1 according to the first and second embodiments in that the control unit 7 includes a print job interrupt processor 71*a* instead of the operation mode selection processor 71.

The print job interrupt processor 71*a* controls so as to perform the print job at speed when the administrator selects any of a mode for performing the print job with reduced noise (hereinafter referred to as "sound reduction mode") or a mode for performing the print job prioritizing performance over noise (hereinafter referred to as the "normal mode") with the operation unit 5. The details of the process by the print job interrupt processor 71*a* will be described later.

Figure 7A:
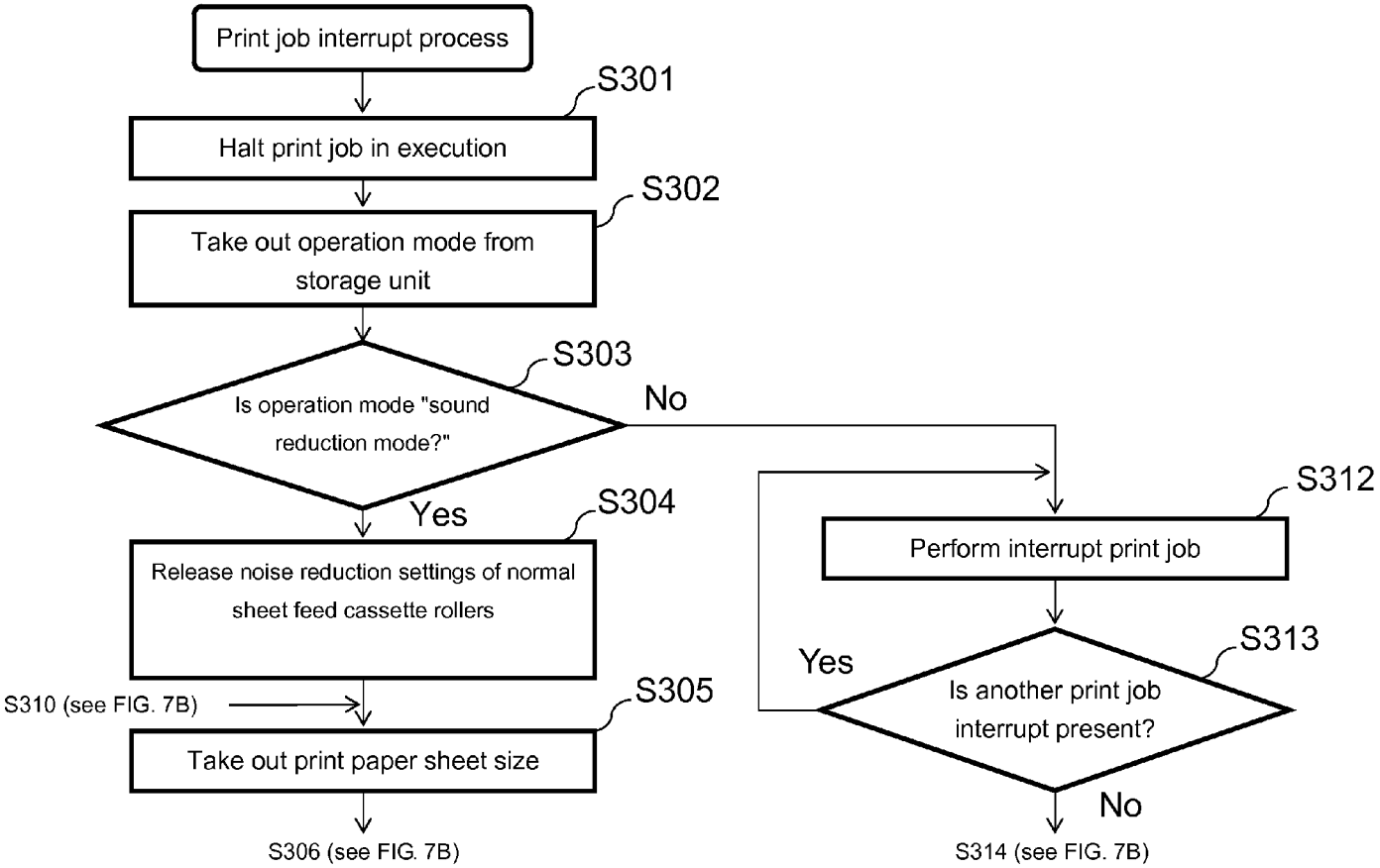
FIGS. 7A and 7B are flowcharts of a process flow of a print job interrupt process according to the third embodiment.
Figure 7B:
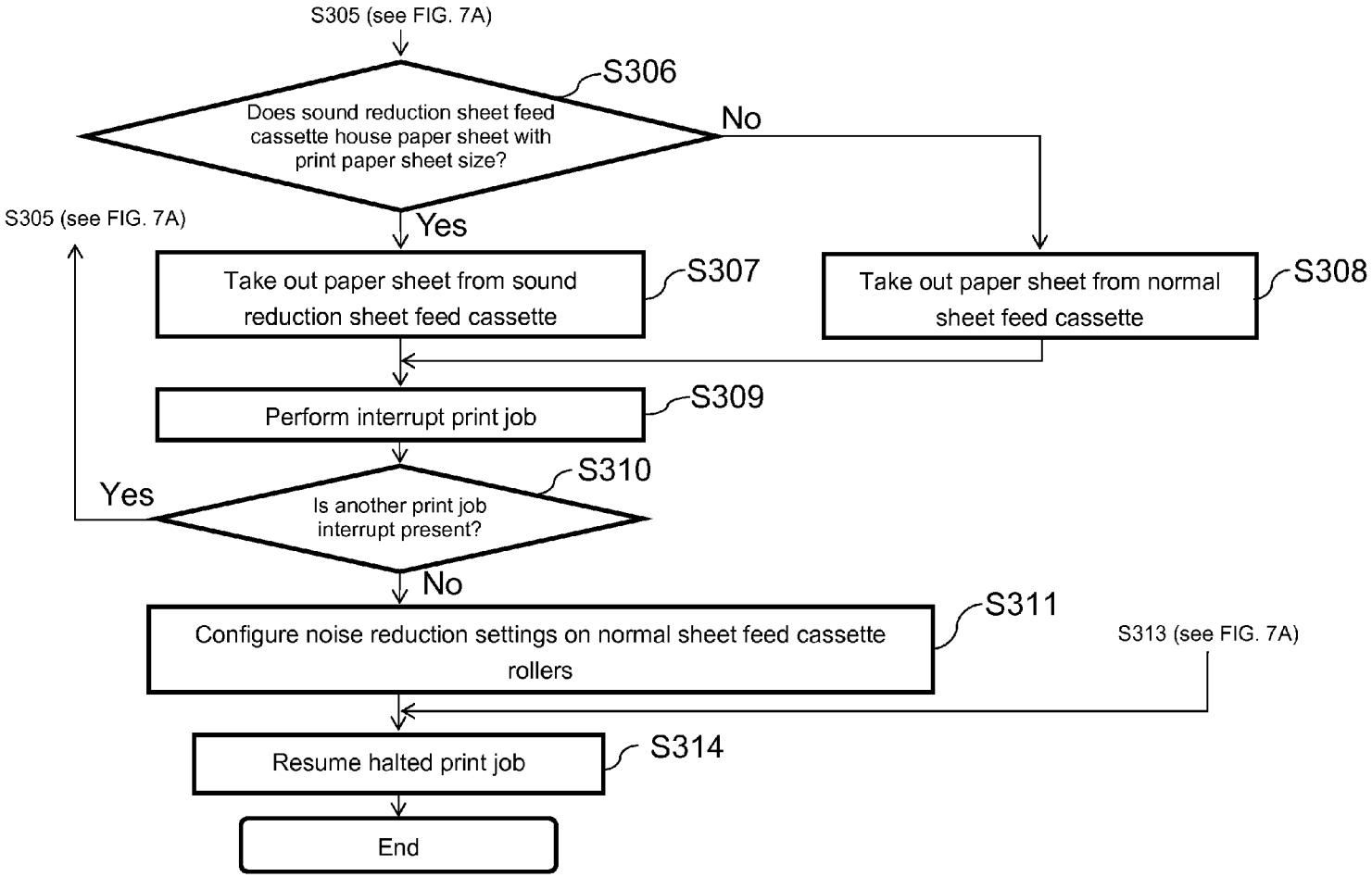

The following describes a print job interrupt process by the image forming apparatus 1*a* according to the third embodiment with reference to FIGS. 7A and 7B. When the user sets the number of print copies, the duplex printing setting, the print paper sheet size, the magnification, the print density, or a similar item on the touch panel of the liquid crystal display unit 51 and performs a print job interrupt with the operation button 52, the operation unit 5 inputs these settings and interrupt of print job, and outputs the inputs to the control unit 7. When these settings and interrupt of print job are input to the control unit 7, the control unit 7 starts the print job interrupt processor 71*a*, and the print job interrupt processor 71*a* starts the print job interrupt process.

At Step S301, the print job interrupt processor 71*a* halts the print job in execution.

At Step S302, the print job interrupt processor 71*a* takes out the operation mode stored in the storage unit 8.

At Step S303, the print job interrupt processor 71*a* determines whether the operation mode taken out at Step S302 is "sound reduction mode" or not. When the operation mode is "sound reduction mode" (Yes at Step S303), the process proceeds to Step S304. When the operation mode is not "sound reduction mode" (No at Step S303), the process proceeds to Step S312.

At Step S304, in the case of Yes in Step S303, the print job interrupt processor 71*a* releases "noise reduction settings" of the normal sheet feed cassette roller 42*a* and the normal sheet feed cassette roller 42*b* in "sound reduction mode. Releasing "noise reduction setting" configures the normal sheet feed cassette roller 42*a* and the normal sheet feed cassette roller 42*b* to "full speed." Note that, when the operation mode is "sound reduction mode", the sound reduction sheet feed cassette roller 42*c* rotates in "full speed" and does not change the speed of rotation.

At Step S305, subsequent to Step S305 or Yes at Step S310, the print job interrupt processor 71*a* takes out the print paper sheet size from the control unit 7.

At Step S306, the print job interrupt processor 71*a* determines whether the sound reduction sheet feed cassette 41*c* includes the paper sheet P with the print paper sheet size or not. When the sound reduction sheet feed cassette 41*c* includes the paper sheet P with the print paper sheet size (Yes at Step S306), the process proceeds to Step S307. When the sound reduction sheet feed cassette 41*c* does not include the paper sheet P with the print paper sheet size (No at Step S306), the process proceeds to Step S308.

At Step S307, in the case of Yes in Step S306, the print job interrupt processor 71*a* configures setting so that the paper sheet P may be taken out from the sound reduction sheet feed cassette 41*c*. For example, when the print paper sheet size is "A4 size", and the paper sheet P included in the sound reduction sheet feed cassette 41*c* is "A4 size", the paper sheet P is taken out from the sound reduction sheet feed cassette 41*c*.

At Step S308, in the case of No in Step S306, the print job interrupt processor 71*a* configures setting so that the paper sheet P may be taken out from the normal sheet feed cassette 41*a* or the normal sheet feed cassette 41*b* including the paper sheet P with the print paper sheet size. For example, when the print paper sheet size is "A3 size", and the paper sheet P included in the normal sheet feed cassette 41*b* is "A3 size", the paper sheet P is taken out from the normal sheet feed cassette 41*b*.

At Step S309, the print job interrupt processor 71*a* performs the interrupt print job.

At Step S310, the print job interrupt processor 71*a* determines whether another print job interrupt is present or not. When another print job interrupt is present (Yes at S310), the process returns to Step S305. When another print job interrupt is absent (No at Step S310), the process returns to Step S311.

At Step S311, in the case of Yes in Step S310, the print job interrupt processor 71*a* configures "noise reduction settings" on the normal sheet feed cassette roller 42*a* and the normal sheet feed cassette roller 42*b* where "sound reduction mode" is released. Configuring "noise reduction setting" sets the normal sheet feed cassette roller 42*a* and the normal sheet feed cassette roller 42*b* to "half speed."

At Step S312, in the case of No in Step S303, the print job interrupt processor 71*a* performs the interrupt print job in "normal mode."

At Step S313, the print job interrupt processor 71*a* determines whether another print job interrupt is present or not. When another print job interrupt is present (Yes at S313), the process returns to Step S312. When another print job interrupt is absent (No at Step S313), the process returns to Step S314.

At Step S314, subsequent to Step S311 or No at Step S313, the print job interrupt processor 71*a* resumes the print job halted at Step S301 and terminates the print job interrupt process.

Accordingly, in "sound reduction mode" of the operation mode, when the interrupt print job is present, releasing the noise reduction settings of the normal sheet feed cassette roller 42*a* and the normal sheet feed cassette roller 42*b* sets the full speed. When the sound reduction sheet feed cassette 41*c* includes the paper sheet P with the print paper sheet size, since the sound reduction sheet feed cassette roller 42*c* of the sound reduction sheet feed cassette 41*c* is at the full speed, this ensures coexistence of the noise reduction and the performance in execution of the interrupt print job. When the sound reduction sheet feed cassette 41*c* does not include the paper sheet P with the print paper sheet size, since the normal sheet feed cassette roller 42*a* or the normal sheet feed cassette roller 42*b* corresponding to the normal sheet feed cassette 41*a* or the normal sheet feed cassette 41*b* including the paper sheet P with the print paper sheet size is at the full speed, this ensures improving the performance in execution of the interrupt print job. When terminating the interrupt print job, restoring the noise reduction settings of the normal sheet feed cassette roller 42*a* and the normal sheet feed cassette roller 42*b* sets the half speed, bringing the noise reduction. In "normal mode" of the operation mode, since the normal sheet feed cassette roller 42*a* or the normal sheet feed cassette roller 42*b* corresponding to the normal sheet feed cassette 41*a* or the normal sheet feed cassette 41*b* including the paper sheet P with the print paper sheet size is at the full speed, this ensures improving the performance in execution of the interrupt print job.

The embodiment where the image forming apparatus 1*a* includes the normal sheet feed cassette 41*a*, the normal sheet feed cassette 41*b*, and the sound reduction sheet feed cassette 41*c* is described above. This, however, should not be construed in a limiting sense. The image forming apparatus 1 can also include a plurality of sound reduction sheet feed cassettes.

Regarding the speeds of the normal sheet feed cassette roller 42*a*, the normal sheet feed cassette roller 42*b*, and the sound reduction sheet feed cassette roller 42*c*, two levels of the full speed and the half speed are employed. However, this is merely an example. The speeds can include a plurality of levels with respect to the normal paper feeding speed, such as the full speed, ⅔, and ⅓; or the full speed, ¾, ⅔, and ¼.

The procedure of performing the print job interrupt from the touch panel of the liquid crystal display unit 51 of the image forming apparatus 1 is described. However, even if the print job interrupt is performed from the peripheral 11 connected to the network 10 to the image forming apparatus 1*a* or another image forming apparatus 1*b*, the print job interrupt process can be performed.

Such image forming apparatus of the third embodiment uses both the sound reduction sheet feed cassette and the normal sheet feed cassette, reducing the cost. When performing the interrupt print job in the noise reduction setting, the noise reduction setting is released to perform the print job at speed. After executing the print job at speed, automatically restoring the noise reduction setting and resuming the halted print job ensures improving user's convenience and the performance of the print job.

The disclosure is described above with the specific embodiments; however, the above-described embodiments are examples of the disclosure, and it is needless to say that the disclosure is not limited to the embodiments.

The disclosure is preferable for an image forming apparatus; however, this should not be limited to the image forming apparatus. The disclosure is applicable to general apparatuses that include a device and a process ensuring achieving noise reduction.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an operation unit that performs settings of the image forming apparatus and instructs operations on the image forming apparatus;

a sound reduction sheet feed cassette that includes a plurality of paper sheets on which sound reduction measures have been taken, the sound reduction measures including a sound absorbing member that covers at least some surfaces of the sound reduction sheet feed cassette;

a normal sheet feed cassette that includes a plurality of paper sheets on which no sound reduction measures have been taken;

a sound reduction sheet feed cassette roller that feeds paper sheets from the sound reduction sheet feed cassette; and a normal sheet feed cassette roller that feeds paper sheets from the normal sheet feed cassette; wherein the sound reduction sheet feed cassette roller and the normal sheet feed cassette roller switch their respective rotation speeds between a normal sheet-feeding speed, and a slow sheet-feeding speed slower than the normal sheet-feeding speed;

the image forming apparatus further comprises an operation mode selection processor that controls print jobs in an operation mode selected on the operation unit, the operation mode including a sound reduction mode for performing print jobs with reduced noise, and a normal mode serving as a high-performance mode for performing print lobs prioritizing performance over noise reduction, the sound reduction mode including a high noise-reduction mode, a noise reduction high-performance mode, and a noise reduction low-performance mode;

the operation mode selection processor calculates a count of printed paper sheets in the sound reduction sheet feed cassette, and in cases where the sound reduction mode is selected, i) the noise reduction high-performance mode is performed if the count of printed paper sheets in the sound reduction sheet feed cassette is equal to or less than a maximum endurance count of sheets for the sound reduction sheet feed cassette, and the operation mode selection processor causes the sound reduction sheet feed cassette roller to set its rotation speed to the normal sheet-feeding speed and to feed paper sheets from the sound reduction sheet feed cassette, and ii) the noise reduction low-performance mode is performed if the count of printed paper sheets in the sound reduction sheet feed cassette is more than the maximum endurance count of sheets, and the operation mode selection processor causes the normal sheet feed cassette roller to set its rotation speed to the slow sheet-feeding speed and to feed the paper sheet from the normal sheet feed cassette, and in cases where the normal mode is selected, the high performance mode is performed, and the operation mode selection processor causes the normal sheet feed cassette roller to set its rotation speed to the normal sheet-feeding speed and to feed paper sheets from the normal sheet feed cassette;

the operation mode selection processor further takes out a count of print jobs waiting for printing, and in cases where the sound reduction mode is selected, iii) the noise reduction high-performance mode is performed if the count of printed paper sheets in the sound reduction sheet feed cassette is equal to or less than the maximum endurance count of sheets for the sound reduction sheet feed cassette, and if the count of print jobs waiting for printing is more than a specified maximum count of jobs waiting for printing, and iv) the high noise-reduction mode is performed if the count of printed paper sheets in the sound reduction sheet feed cassette is equal to or less than the maximum endurance count of sheets for the sound reduction sheet feed cassette, and if the count of print jobs waiting for printing is equal to or less than the specified maximum count of jobs waiting for printing, and the operation mode selection processor causes the sound reduction sheet feed cassette roller to set its rotation speed to the slow sheet-feeding speed and to feed paper sheets from the sound reduction sheet feed cassette.

2. The image forming apparatus according to claim 1, wherein, in a case where the sound reduction mode is selected, if the sound reduction sheet feed cassette does not include the paper sheets with a print paper sheet size and one of the noise reduction high-performance mode and the high noise-reduction mode cannot be performed, the noise reduction low-performance mode is performed.

3. The image forming apparatus according to claim 1, further comprising a storage unit, wherein the specified maximum count of sheets and the specified maximum count of jobs waiting for printing are stored in the storage unit.

4. An image forming apparatus according to claim 1, further comprising a print job interrupt processor that performs an interrupt print job, wherein, in a case where the sound reduction mode is selected, if the print job interrupt processor determines a print job is an interrupt print job, one of the noise reduction high-performance mode and the high performance mode is performed.

5. The image forming apparatus according to claim 4, wherein:

the noise reduction high-performance mode is preferred to the high performance mode;

if the sound reduction sheet feed cassette does not include paper sheets with an interrupt print paper sheet size, the high performance mode is performed; and if the sound reduction sheet feed cassette includes paper sheets with an interrupt print paper sheet size, the noise reduction high-performance mode is performed.

6. The image forming apparatus according to claim 4, wherein if an interrupt print job is terminated, one of the high noise reduction mode, the noise reduction high-performance mode, and the noise reduction low-performance mode is performed.

7. The image forming apparatus according to claim 4, wherein the print job interrupt processor breaks a print job to perform an interrupt print job.

8. The image forming apparatus according to claim 7, wherein the print job interrupt processor resumes a broken print job when an interrupt print job is terminated.

* * * * *